US005432499A

United States Patent [19]

Montean

[11] Patent Number: 5,432,499

[45] **Date of Patent: * Jul. 11, 1995**

[54] COLLECTOR TYPE ARTICLE SURVEILLANCE MARKER WITH CONTINUOUS KEEPER

[75] Inventor: Samuel Montean, Blaine, Minn.

[73] Assignee: Minnesota Mining and Manufacturing Company, St. Paul, Minn.

[ * ] Notice: The portion of the term of this patent subsequent to Oct. 30, 2007 has been disclaimed.

[21] Appl. No.: 68,623

[22] Filed: May 27, 1993

[51] Int. Cl.[6] ..... G08B 13/14

[52] U.S. Cl. ..... 340/572; 340/551

[58] Field of Search ..... 340/572, 551

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 4,120,704 | 10/1978 | Anderson | 148/103 |
| 4,689,590 | 8/1987 | Heltemes | 340/572 |
| 4,710,754 | 12/1987 | Montean | 340/572 |
| 4,746,908 | 5/1988 | Montean | 340/551 |
| 4,825,197 | 4/1989 | Church et al. | 340/572 |
| 4,884,063 | 11/1989 | Church et al. | 340/572 |
| 4,967,185 | 10/1990 | Montean | 340/572 |

FOREIGN PATENT DOCUMENTS 763681 5/1934 France .

*Primary Examiner*—John K. Peng
*Assistant Examiner*—Albert K. Wong
*Attorney, Agent, or Firm*—Gary L. Griswold; Walter N. Kirn; Kari H. Bartingale

[57] ABSTRACT

A dual-status marker for use in electronic article surveillance systems having an alternating magnetic field within an interrogation zone. The marker comprises a piece of a high permeability, low coercive force magnetic material substantially coextensive with a piece of remanently magnetizable material. The first piece is rectangular and exhibits lengthwise sections at which the material is removed, thus leaving narrow width regions forming switching sections, portions adjacent each end forming flux collectors. The marker is desensitized by uniformly magnetizing the piece of remanently magnetizable material.

10 Claims, 2 Drawing Sheets

COLLECTOR TYPE ARTICLE SURVEILLANCE MARKER WITH CONTINUOUS KEEPER

FIELD OF THE INVENTION

This invention relates to electronic article surveillance (EAS) systems of the general type in which an alternating magnetic field is produced in an interrogation zone and in which a magnetically responsive marker present in the zone results in the production of a characteristic signal which is detected and processed to create a suitable response such as an audible or visible alarm.

BACKGROUND OF THE INVENTION

Modern magnetically based electronic article surveillance systems generally derive their parentage from 1934 French Patent No. 763,681. That patent depicts the use of markers formed of a piece of low coercive force, high permeability alloy, such as permalloy, and teaches that when the magnetization of such a piece is reversed by a magnetic field alternating at a fundamental frequency, detectable harmonics of that frequency will be produced.

More recently, various investigators have developed magnetic markers which have dual-status capabilities. Typically, as first disclosed in U.S. Pat. Nos. 3,665,449 (Elder et al.) and 3,747,086 (Peterson), such dual-status markers include at least one piece of low coercive force, high permeability material together with at least one piece of remanently magnetizable material. When the latter piece is magnetized it has associated therewith a magnetic field which biases the low coercive force, high permeability material so as to alter the signal produced when the biased material is in the interrogation field. It is also disclosed in the '449 patent that such dual-status markers may comprise coextensive strips of magnetizable material and high permeability, low coercive force material, and while not preferred, that the magnetizable material could be uniformly magnetized.

Similarly, one marker embodiment depicted in the '086 patent comprises two coextensive strips. While that patent indicates that magnetization of one strip alters the harmonic content of the signal produced by the other, the exact nature of the magnetization is not specified. The disclosure pertaining to FIG. 6D of the '086 patent suggests only that magnetization be such as to leave the responder strip in a fully magnetized condition, thereby causing the marker to be completely silent.

The '449 and '086 patents thus suggest that single directionally responsive markers may be deactivated by a magnetic bias field extending the full length of the responder strip, but fail to enable that suggestion. Rather, by following the teaching in those and subsequent patents it has become well recognized that reliable deactivation is obtained by providing discontinuous fields so that the responder strip essentially responds as a number of strips of shorter length. This is effected in typical, commercially viable systems by providing a number of magnetizable pieces spaced along the responder strip or by providing a continuous strip of magnetizable material which is magnetized in bands of alternating polarity.

More recently, multi-directionally responsive magnetic markers have also been developed. Thus, for example, as set forth in a prior patent of the present inventor, U.S. Pat. No. 4,710,754, such markers may comprise a square piece of low coercive force, high permeability material fabricated to have regions with narrow widths centered along each edge of the squares, thereby providing switching sections, and extensive regions in each corner which collect and channel flux into the switching sections. The markers of the '754 patent are made dual-status by adding discrete pieces of magnetizable material adjacent each switching section.

A further embodiment of a dual-status, multi-dimensionally responsive marker is disclosed in U.S. Pat. No. 4,825,194 (Church et al.) in which discrete magnetizable pieces are positioned adjacent flux collector sections of a sheet of responder material. Optionally, that patent also suggests that additional pieces of magnetizable material may be positioned adjacent the switching sections, but that the separation between the respective magnetizable pieces be sufficient to prevent appreciable magnetic coupling therebetween.

Multi-dimensionally responsive markers in which a coextensive sheet of magnetizable material is provided together with a sheet of low coercive force, high permeability responder material are disclosed in a second patent of the present inventor, U.S. Pat. No. 4,746,908. However, the markers of the '908 patent function in a significantly different manner and utilize a piece of responder material configured so as not to create a desired response. The coextensive sheet of magnetizable material is magnetized with a predetermined pattern which biases only adjacent portions of the responder material, thereby inhibiting response from those portions. The magnetized pattern is such that the dimensions of the unbiased, remaining portion can then produce the desired response. Such markers thus function oppositely to those in typical use, i.e., that the marker is magnetized when in its sensitive state.

A third patent of the present inventor, U.S. Pat. No. 4,967,185, discloses that multi-dimensionally responsive markers somewhat similar to those preferred in the '754 patent may be reliably changed from a first, active state, to a second, deactive state, by applying a magnetic field to uniformly magnetize a coextensive magnetizable sheet in any direction in the plane of the sheet. The marker may be subsequently changed, or switched back to the active state by demagnetizing the magnetizable sheet. Such a marker thus may comprise two coextensive magnetic sheets in which the width of the sheets is not less than one-half the length. The first sheet may be selected of a material having a high permeability and low coercive force, which is configured to have at least two, mutually perpendicular elongated areas proximate to the periphery of the sheet. Each of the elongated areas is capable of responding to an alternating magnetic field in an interrogation zone generally applied along the length of the area to result in the production of an alarm. Each area thus includes a narrow width region forming a switching section and extends on each end along the length into extensive regions forming flux collector sections for the adjacent switching section.

The second sheet is selected of a remanently magnetizable material, which overlies and is magnetically coupled to the sheet of responder material. This magnetizable sheet, when substantially uniformly magnetized in the plane of the sheet, causes alternate polarity switching pulses resulting from a reversal of magnetization of the switching sections when exposed to alternating fields, to be shifted in time and/or altered in amplitude. Markers having the magnetizable sheet alternatively magnetized or demagnetized can then be distinguished from each other.

As noted above, the two states of the marker of the '185 patent are manifested by differences in the time at which alternate polarity pulses are produced and by differences in the amplitude of the respective pulses, depending upon whether or not the magnetizable sheet is magnetized. That patent invention thus also includes an EAS system for use with such markers. In addition to the markers themselves, the system thus comprises means, such as a drive oscillator, amplifier, and field coils, for generating within an interrogation zone an alternating magnetic field, means for receiving marker produced signals and ultimately producing an alarm signal when appropriate and means for magnetizing the magnetizable material in the markers. The magnetizing means preferably provides a single, substantially uniform magnetic dipole in the magnetizable sheet, one edge of the sheet having one magnetic polarity and an opposite edge having the opposite polarity.

The receiving means receives signals resulting from flux changes in the marker produced when the marker is exposed to the alternating field in the zone. Means are also included for distinguishing between signals from the markers when the piece of magnetizable material is either magnetized to have a said single magnetic dipole or is demagnetized, and from other signals as may be caused by ambient effects, random ferromagnetic objects and the like. The distinguishing means further comprises means responsive to differences in the amplitude of marker produced signals and to relative displacements of alternate signal components for producing an alarm signal when appropriate.

SUMMARY OF THE INVENTION

While similar to the multi-dimensionally responsive marker of the '185 patent, the marker of the present invention is primarily responsive in but one direction, but is significantly less expensive. The marker comprises a substantially rectangular sheet of high permeability, low coercive force ferromagnetic responder material having a predetermined width and length. This sheet has sections along its length at which the material is removed, the remaining material thus forming at least one area of narrow width which may function as a switching section. Reversal of the magnetic state in that section by an alternating field of an EAS system interrogation zone may thus create a characteristic response while the remaining lengthwise portions function to collect and channel flux into the switching section.

The marker further includes a sheet of remanently magnetizable material having substantially the same overall dimensions as the sheet of responder material, overlying and magnetically coupled to the sheet of responder material. When the magnetizable sheet is substantially uniformly magnetized in its plane, the associated external field causes alternate switching pulses resulting from a reversal of magnetization of the switching section to be shifted in time and/or altered in amplitude, thereby changing the characteristic response and enabling markers having the magnetizable sheet magnetized or demagnetized to be distinguished from each other.

In a preferred embodiment, opposing edges along which the material is removed are defined by a continuous narrow band in which the material is absent, the remaining portions of the sheet outside that band thus being substantially magnetically isolated from the rest of the sheet, but physically present. This enables the sheet to provide a substantially uniformly thick, homogeneous appearance to a complete marker.

As noted above, the two states of the marker of the present invention are manifested by differences in the time at which alternate polarity pulses are produced and by differences in the amplitude of the respective pulses, depending upon whether or not the magnetizable sheet is magnetized. The present invention thus also includes an EAS system for use with the markers described above. In addition to the markers themselves, the system thus comprises apparatus such as a drive oscillator, amplifier, and field coils, for generating within an interrogation zone an alternating magnetic field, circuits for receiving marker produced signals and ultimately producing an alarm signal when appropriate and apparatus for changing the magnetization state of the magnetizable material in the markers. This latter apparatus preferably magnetizes the magnetizable material to provide a single, substantially uniform magnetic dipole in the magnetizable sheet, one edge of the sheet having one magnetic polarity and an opposite edge having the opposite polarity.

The receiving circuits receive signals resulting from flux changes in the marker produced when the marker is exposed to the alternating field in the zone. Circuits are also included for distinguishing between signals from the markers when the piece of magnetizable material is either magnetized to have a said single magnetic dipole or is demagnetized, and from other signals as may be caused by ambient effects, random ferromagnetic objects and the like. The distinguishing circuits further respond to differences in the amplitude of marker produced signals and to relative displacements of alternate signal components for producing an alarm signal when appropriate.

DETAILED DESCRIPTION

Figure 1A:
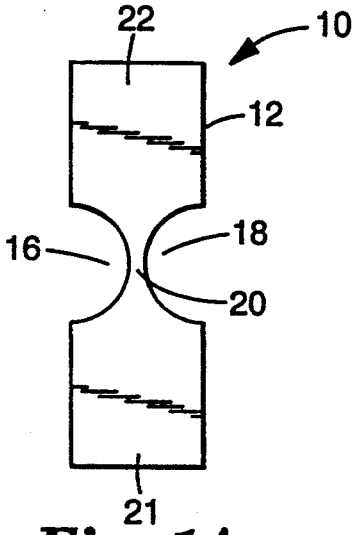
FIGS. 1A and 1B are top views of the two magnetic sheets comprising a marker of one embodiment of the present invention.
Figure 1B:
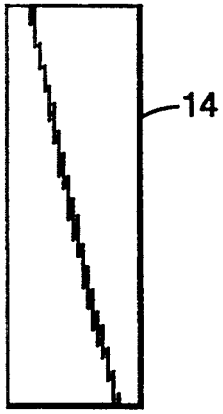

One embodiment of a marker of the present invention is set forth in FIGS. 1A and 1B. As may there be seen, such a marker 10 comprises two sheets 12 and 14 of magnetic material. The first sheet 12 is formed of a ferromagnetic material having high permeability and low coercive force properties, such as permalloy, supermalloy or the like. This sheet may also be any of a number of amorphous ferromagnetic compositions, such as an iron-nickel composition, Type 2628MB2 or a high cobalt containing composition, Type 2705M, both of which are manufactured by the Allied-Signal Corporation. The sheet 12 is configured in a rectangle having semicircular portions 16 and 18 removed from each lengthwise edge, thus leaving a centermost area 20 of restricted cross-section. This area thus forms a switching section in which magnetic flux will be concentrated by the extensive areas 21 and 22 at the respective ends of the rectangle.

As shown in FIG. 1B, the second sheet 14 of the marker 10 is coextensive with the first sheet 12 and comprises a solid sheet of a magnetizable material, such as vicalloy, magnetic stainless steel, Chromendur II or the like. A preferred construction utilizes Arnokrome TM, an iron, cobalt, chromium and vanadium alloy marketed by Arnold Engineering Co., Marengo, Ill., such as the Alloy "A" described in U.S. Pat. No. 4,120,704, which is assigned to that company. In a particularly desired configuration, a sheet of such material may be heat treated to provide a coercive force of approximately 80 Oersteds. Other alloys having coercive forces in the range of 40 to 200 Oersteds are likewise acceptable. To ensure the same response to both desensitizing (magnetizing) fields and to interrogating fields, regardless of the orientation of the marker with respect to those fields, it is also desirable that the sheets exhibit the same magnetic properties in all directions in the plane of the sheet.

The two sheets 12 and 14 are then preferably joined together via a pressure-sensitive adhesive or the like and the combined layers in turn are sandwiched between an underlying layer of pressure-sensitive adhesive and release liner in order to allow the markers to be dispensed and fixed to articles to be protected. A suitable top layer may also be included, enabling customer indicia, price information etc. to be provided on the marker.

In a preferred embodiment as shown in FIGS. 1A and 1B, the first sheet 12 was made of a one inch (2.54 cm) long and one-third inch (0.85 cm) wide section of permalloy, 0.0006 inches (15.2 micrometers) thick. The sheet was further formed with the removed sections 16 and 18 having a radius of about 0.154 inches (0.39 cm), thus leaving the switching section 20 to be about as 0.025 inches (635 micrometers) wide. The second sheet 14 was a one inch (25.4 cm) by one-third inch (0.85 cm) section of Arnochrome TM alloy 0.0008 inches (20.3 micrometers) thick, treated to have a coercive force of about 80 Oe (6400 A/m), as described above.

It has now been found that such a marker may be reliably switched from a first, active state into a second, deactivated state, by substantially uniformly magnetizing the magnetizable sheet in its plane so as to exhibit a first magnetic polarity along one edge of the sheet and an opposite polarity at the opposite edge of the sheet. By so magnetizing the magnetizable sheet, the switching element becomes biased so that alternate polarity switching pulses from the respective elements occur at different times than that occurring from an unbiased marker, and/or the respective switching pulses are significantly altered in amplitude.

An unbiased switching element saturates or switches in an alternating magnetic field when the field reaches a given intensity, depending upon the coercive force of the switching element. Accordingly, if the time between a negative and positive pulse is substantially the same as the time between a positive and negative pulse when the marker is interrogated by a sinusoidal alternating field, the marker will be deemed to be sensitized. In contrast, if the magnetizable sheet is magnetized, the time between adjacent positive and negative pulses will be different than that between adjacent negative and positive pulses. The detection logic in a system may then be used to detect such time differences, and thus differentiate between an unbiased (sensitized) marker and a biased (desensitized) marker. As the amplitudes of harmonics generated by a marker when interrogated by an alternating magnetic field are also substantially altered, and for the most part, decreased by the presence of the bias due to the magnetized sheet, detection logic may also be utilized to respond to such differences in amplitude.

It has also been found that when the sheet of magnetizable material is magnetized by an unidirectional field so as to exhibit a single magnetic dipole extending from one edge to the opposite edge of the sheet, that magnetization may be affected by the configuration of the adjacent high permeability, low coercive force sheet. By selecting the sheet of magnetizable material to have a relatively low coercive force, i.e., in the range of 60–90 Oersteds, the magnetizable material may be magnetically imprinted with the configuration of the sheet of responder material. Such a magnetization pattern can, for example, be seen by separating the sheet of responder material from the magnetizable sheet and thereupon viewing the magnetization pattern with a magnetic viewer. The magnetization pattern arises during the magnetization process because some of the flux coming out of the flux collector and switching sections enters the relatively low coercive force sheet of magnetizable material and thereby alters the magnetization therein. The collector and switching elements thus ultimately become more highly saturated and the state of desensitization of the marker is thereby enhanced.

Figure 2:
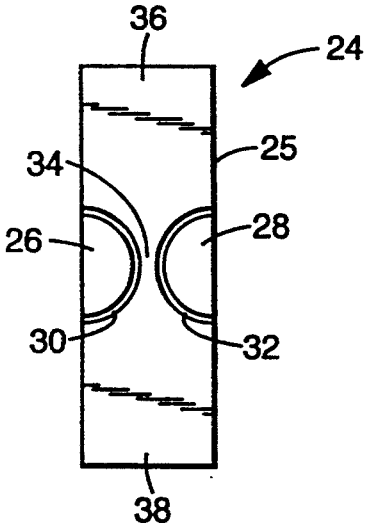
FIG. 2 is a top view of the responder sheet of another embodiment of a marker according to the present invention.

As shown in FIG. 2, in an alternative embodiment, the marker 24 may be formed of a sheet 25 of high permeability, low coercive force material in which the most of the removed portions 26 and 28 along lengthwise edges are still present, but are separated from the remainder of the sheet by narrow bands 30 and 32 in which the magnetic material has been removed. The narrow band of removed material 30 and 32 thus magnetically isolates the portions 26 and 28 from the magnetically active switching section 34 and flux collector sections 36 and 38 respectively.

Figure 3A:
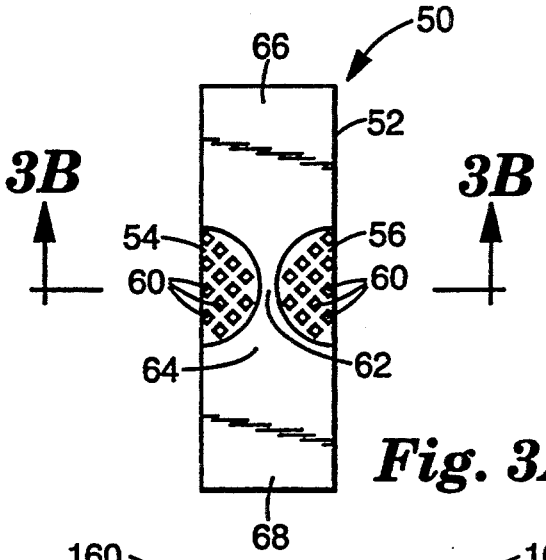
FIGS. 3A and 3B are top and cross-sectional views of yet another embodiment of the present invention.
Figure 3B:
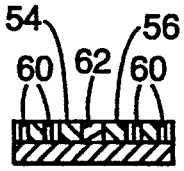

Another embodiment of the marker of the present invention is shown in FIGS. 3A and 3B. As shown in FIG. 3A, the marker 50 is formed of a sheet 52 of high permeability, low coercive force responder material like that described in conjunction with FIGS. 1A and 2. In the embodiment of FIG. 3A, magnetically inactive region 60 are provided by removing regions 54 and 56, the remaining material thus being magnetically isolated from both the adjacent regions and from the remainder of the sheet, and unable to significantly affect the concentration of flux within the centermost region 62. By thus subdividing the remaining material in the inactive region 60, the propensity for flux directed toward the marker to pass through those regions is further lessened. The flux collecting capabilities of the end regions 66 and 68, and redirection of that flux into the switching section 64 is thereby maximized.

Figure 4:
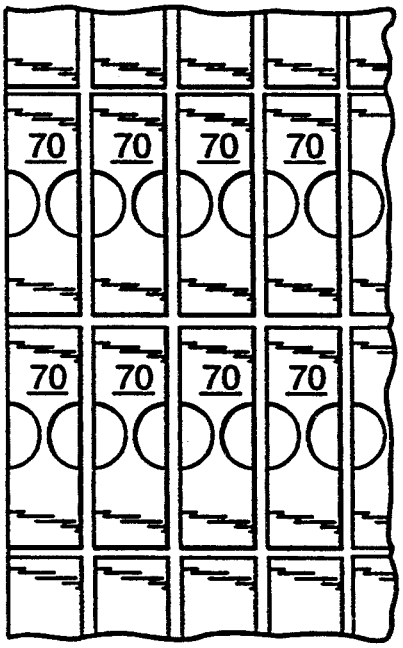
FIG. 4 is a top view of a plurality of markers each as shown in FIGS. 1A and B.
Figure 5:
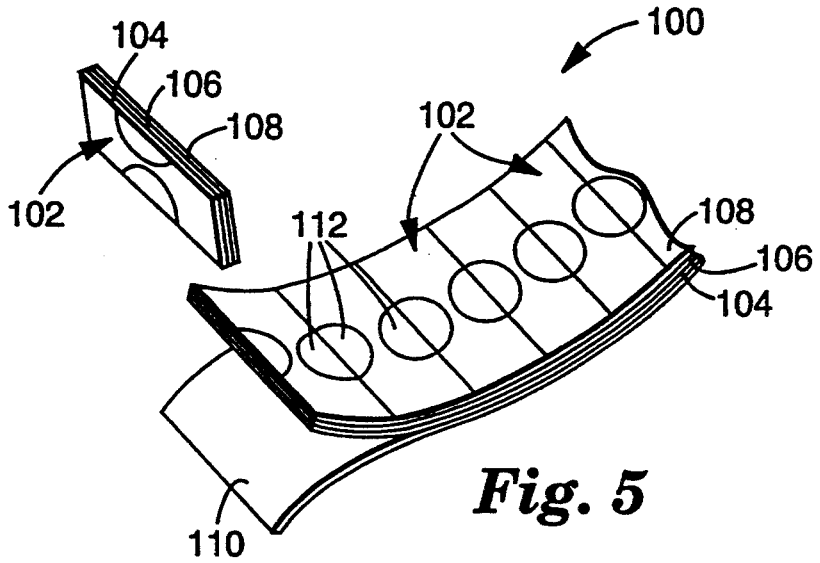
FIG. 5 is a perspective view of a strip of markers as shown in FIGS. 1A and 1B.

A preferred manner in which the markers of the present invention may be manufactured is set forth in FIG. 4. It will there be recognized that a plurality of markers 70 extending in orthogonal directions from each other may be formed from large sheets of the respective materials, the sheet of responder material having been first processed to have a plurality of equally spaced-apart holes formed therein, the spacing between which defines the width of the switching sections of the resultant markers. After the respective sheets are laminated together, the respective markers may then be cut into strips as shown in FIG. 5, in a manner suitable for dispensing with conventional label guns and the like. In FIG. 4, the respective markers are shown spaced apart to clarify that the sheets are cut so as to generally bisect the holes.

As shown in FIG. 5, a strip 100 contains a plurality of markers 102. The strips 100 of markers 102 include a sheet 104 of high permeability, low coercive force material in which the appropriate configuration has been formed, adhered via a layer of pressure sensitive adhesive (not shown) to a sheet of magnetizable material 106. An outermost layer 108 of paper or the like on which customer indicia may be printed may, in turn be adhered to the top of the magnetizable material 106. An underlying layer of pressure-sensitive adhesive between the bottom most layer 104 and release liner 110 may be provided in order to affix the markers to objects to be protected. Such an adhesive layer is nominally invisible.

The benefit provided by the semi-circular holes 112 along the periphery of each of the markers may further be appreciated from FIG. 5, as it will there be noted that as the individual markers are cut from the larger sheets from which they are formed, any variance in the location of the separation lines will only affect the relative location of the switching sections. As the widths of the respective switching sections are precisely determined by the distance between adjacent holes, the exact location of the separation line becomes much less important.

The configuration in the sheets of high permeability, low coercive force material may be provided in a number of ways, such as die cutting, etching or the like. When sheets of crystalline materials, such as permalloy or the like, are utilized, such materials being notoriously sensitive to mechanical working, it may be desired that the respective regions of removed material be formed via chemical etching techniques in a manner well known to those skilled in the art. Similarly, if sheets of material relatively immune to mechanical workings, such as amorphous alloys, are utilized, conventional die cutting techniques and the like may similarly be employed.

Figure 6:
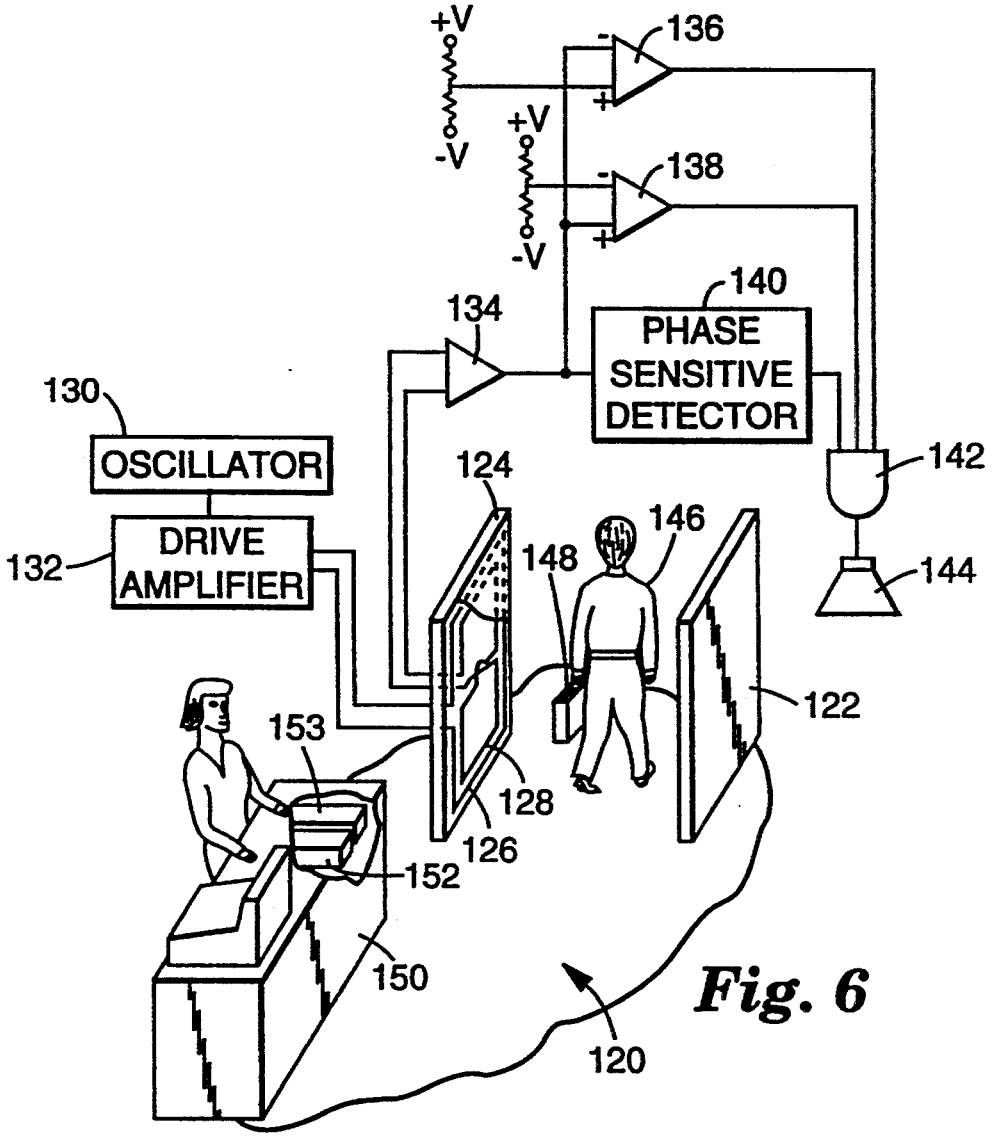
FIG. 6 is a combined pictorial and block diagram of an embodiment of a system according to the present invention.

A system in which the markers of the present invention are preferably utilized is set forth in the combined pictorial and block diagram of FIG. 6. As is typical in magnetic electronic article surveillance systems, the system 120 comprises two spaced apart panels 122 and 124 between which persons carrying objects protected by the markers may be directed. Within the panels are positioned appropriate field coils 126 and detector coils 128. In the present system, the field coil is powered by a suitable oscillator 130 coupled through a drive amplifier 132, producing a magnetic field oscillating at a predetermined frequency, such as approximately 10 kilohertz, within the interrogation zone extending between the panels. The detector coil 128 is in turn coupled through a sense amplifier and filter 134 and thence to a pair of level detectors 136 and 138, respectively, and to a phase sensitive detector 140. The common outputs of the respective detectors are in turn coupled to an alarm logic network 142, which is basically an exclusive AND gate, such that an appropriate signal from all three detectors must be present for the production of a signal to activate an alarm 144. Thus if a patron 146 carrying objects 148 having markers affixed thereto which are in a sensitized condition passes between the panels 122 and 124, the presence of the sensitized markers will be detected and an alarm produced by the alarm unit 144.

Conversely, if prior to entering the interrogation zone, the markers are desensitized at a checkout counter 150, at which time the respective markers are placed within a desensitization apparatus 152 within which a substantially continuous magnetization state is impressed upon the magnetizable sheets within each of the markers, thereby rendering the marker desensitized, egress through the interrogation zone may be possible without generating an alarm. Such an apparatus may preferably comprise a permanent magnet having at a top, or working surface, a substantially uniform field of a single polarity. The magnetizable sheets of the markers are then magnetized by passing the marker across the working surface of the apparatus.

Alternatively, if objects are desired to be returned to the protected area and removal thereafter again detected, the markers may be resensitized by passing them through a demagnetization apparatus 153. Such an apparatus may comprise a permanent magnet assembly configured to have a series of alternating polarity fields of decreasing intensities so that as a marker is moved thereover, any remanent magnetization state is gradually removed.

The desirability of the detector circuits operating both in response to phases, so as to respond to the respective time between alternate polarity pulses and also to the respective amplitude of the signal pulses, will be further appreciated as it is recognized that as an object is presented for deactivation, the orientation of the marker with respect to the magnetizing fields in the desensitization apparatus 148 will generally be unknown and uncontrolled. Similarly, as an object is carried through the interrogation zone, the orientation of the marker with respect to the interrogating fields will generally be unknown and uncontrolled. Thus it is important that markers be unambiguously recognized as being deactivated regardless of whether the direction of the magnetic dipole impressed on the sheet of magnetizable material is aligned with the interrogating fields, is oriented at 90° with respect to the interrogating fields, or is at any other random angle therebetween.

Taking the two extremes, it will be recognized that if the magnetic dipole is in alignment with an interrogating field, the field associated with the dipole will alternately aid and oppose the interrogating field. In such a case, the time at which the requisite field at which the magnetization in the respective aligned switching elements will reverse will be shifted in time relative to the switching times when no biasing field is present. Such a shift in the spatial position of the signal pulses may then be detected by the phase sensitive detector 140. Conversely, if the field associated with the magnetic dipole is at right angles to the interrogating field, the overall amplitude of the switching pulses will generally be decreased. Such a condition may be recognized by the level detectors 136 and 138, which require signal pulses to exceed a minimum threshold and not to exceed a maximum threshold level in order to create the requisite alarm signal.

In one set of experiments, the performance of a marker as shown in FIG. 2, was compared with the performance of a marker of comparable dimensions (1"by 1"), prepared according to the disclosure in U.S. Pat. No. 4,967,185 and marketed by 3M Company as a Quadratag TM marker. The tested marker of the present invention thus had overall dimensions of one inch (2.54 cm) by one-third inch (0.85 cm) and was formed of a 0.0006 inch (15.2 micrometers) thick sheet of permalloy laminated to a 0.0008 inch (20.3 micrometers) thick sheet of Arnochrome TM. The permalloy sheet was formed to have semicircular sections along the length-wise edges separated from the remainder of the permalloy sheet by a narrow semicircular band. When tested in a representative EAS system, e.g., a Model 3300 EAS system marketed by 3M Company, the marker of the present invention was detected 53% of the time when randomly oriented and variously located throughout the interrogation zone. When similarly tested, the Quadratag marker was detected 76% of the time. It was thus confirmed that the marker of the present invention exhibited reasonable detectability regardless of orientation. The marker was also found to be reliably deactivated when a desensitizer, formed of strips of Neodymium permanent magnets arranged in an X configuration along a band, with the magnets positioned at right angles with respect to each other, and at 45° with respect to the band, was positioned so that the marker passed along the surface at right angles with respect to the band.

Figure 7:
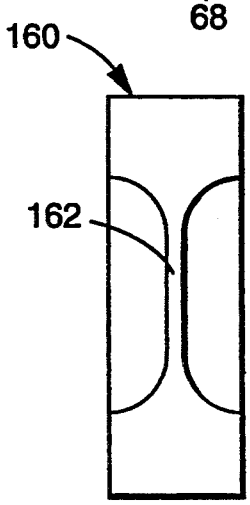
FIG. 7 is a top view of a modified embodiment of a marker substantially like that of FIG. 1.
Figure 8:
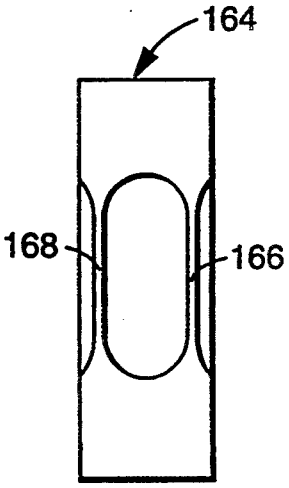
FIG. 8 is a top view of an embodiment of a marker having two length-wise switching sections.

In another set of tests, markers having the configurations shown in FIGS. 7 and 8 were compared. The marker 160 of FIG. 7 was substantially like that of FIG. 1, and was formed of the same materials. It differed only in that material was removed from the length-wise edges of the permalloy sheet so as to leave an approximately one-third of an inch long (0.85 cm), 0.22 inch (0.56 cm) wide center section 162. The single resultant dipole was thereby positioned as far as it could be from the length-wise edges of the marker.

In contrast, the marker 164 of FIG. 8, while having the same overall dimensions as that of FIGS. 1 and 7, was shaped so that the permalloy sheet had two dipoles 166 and 168, each being in close proximity to a length-wise edge.

These two markers were then desensitized by passing them through magnetic fields in the plane of the markers, but with the long axis of the markers being variously positioned at 0° (parallel to the field), 30, 45, 60, and 90 with respect to the field. When tested in apparatus simulating the field and detection parameters used in the Model 3300 EAS System acknowledged above, the data presented in the following table were obtained. In such a system, marker produced signals will only result in the production of an alarm when the signal amplitude is in excess of a given level and at the same time, the time difference is less than a given amount. That is, a sensitized marker in which the magnetizable sheet is unmagnetized will produce high amplitude, harmonic related signals, and the relative time between adjacent positive-negative transitions will be substantially the same as that between adjacent negative-positive transitions. The combination of both signal characteristics will result in an alarm. Contrariwise, alarms will not result even though the signal amplitude is high (i.e., in excess of 2.0 volts, on an arbitrary scale) if at the same time a time difference is also high (i.e., in excess of 5.0 microseconds). An alarm will also be prevented from occurring even though the time difference is less than a minimum amount (i.e., 0–4 microseconds), if at the same time the signal amplitude is low (i.e., less than approx. 0.5 volts).

TABLE I

MEASUREMENTS OF DESENSITIZED MARKERS OF FIGS. 7 AND 8

| | FIG. 7 Marker | | FIG. 8 Marker | |
|---|---|---|---|---|
| Marker Orientation | Signal Amplitude (Volts) | Time Difference (u-sec) | Signal Amplitude (Volts) | Time Difference (u-sec) |
| Parallel to Field | | | | |
| (0 Degrees) | 2.4 | 12.5 | 2.0 | 13.5 |
| 30 Degrees | 0.8 | 0 | 0.3 | 0 |
| 45 Degrees | 1.0 | 9.5 | 0.44 | 9.0 |
| 60 Degrees | 0.88 | 8.0 | 0.3 | 6.0 |
| 90 Degrees | 1.8 | 11.5 | 0.62 | 6.5 |

FIG. 8, having two dipoles near opposite edges were most reliably desensitizable, as they exhibited the lowest amplitude signal and/or the largest time difference between positive-negative versus negative-positive pulses. As noted above, the magnetizable sheets utilized in the markers of the present invention are desirably formed of materials having a coercive force in the range between 40 and 200 Oersteds. Thus, for example, materials such as Arnokrome TM have been evaluated and found to be acceptable. Other materials having similar coercive forces may also be used. Materials having coercive forces in the range of 60–90 Oersteds are particularly desired. The non-uniform magnetization patterns resulting from flux shunting effects of the adjacent, configured piece of responder material are more pronounced. Also, lower intensity magnetizing fields may be employed, thereby lessening the danger of affecting magnetically sensitive objects such as prerecorded magnetic tapes and credit cards.

I claim:

1. A marker for use in an electronic article surveillance system, comprising:

a responder sheet of high permeability, low coercive force ferromagnetic responder material having a predetermined width and length, and having opposing portions along each lengthwise edge from which the responder material is removed, the responder material between the opposing portions forming a switching section, and the responder material extending away from the opposing portions toward each widthwise edge forming flux collecting sections, wherein the switching section produces alternate switching pulses when the magnetic state therein is reversed by an applied alternating magnetic field, and wherein the flux collecting sections collect and channel magnetic flux into the switching section, and a magnetizable sheet of remanently magnetizable material coextensive with the sheet of responder material, overlying and magnetically coupled to the sheet of responder material, which magnetizable sheet, when magnetized causes a shift in the alternate switching pulses from when the magnetizable sheet is not magnetized.

2. A marker according to claim 1, wherein the magnetizable material is selected to exhibit a coercive force in the range between 40 and 200 Oersteds.

3. A marker according to claim 1, wherein the magnetizable sheet is magnetized along any direction in the plane of the magnetizable sheet to exhibit a single magnetic dipole extending from one edge of the magnetizable sheet to an opposite edge thereof.

4. A marker according to claim 1, wherein the magnetizable sheet is magnetized to exhibit a single magnetic dipole extending diagonally from one corner to an opposite corner.

5. A marker according to claim 1, wherein each of the opposing positions comprise a continuous band in which the material is removed, the remaining portions of the sheet outside that band thus being substantially magnetically isolated from the rest of the sheet, but physically present so as to provide a substantially uniformly thick, homogeneous appearance to a complete marker.

6. A marker according to claim 5, wherein the flux collecting section of the responder sheet are divided into a plurality of segments.

7. The marker according to claim 1 wherein each of the opposing portions is semicircular in shape.

8. The marker according to claim 1 wherein the magnetizable sheet is magnetized to cause a time shift in the alternate switching pulses.

9. The marker according to claim 1 wherein the magnetizable sheet is magnetized to cause an amplitude shift in the alternate switching pulses.

10. The marker according to claim 5 wherein the continuous band is semicircular in shape.

* * * * *

UNITED STATES PATENT AND TRADEMARK OFFICE

CERTIFICATE OF CORRECTION

PATENT NO. : 5,432,499

DATED : July 11, 1995

INVENTOR(S) : Samuel Montean

It is certified that error appears in the above-indentified patent and that said Letters Patent is hereby corrected as shown below:

Col. 10, line 17 Before "FIG. 8" insert --It was thus confirmed that the marker of--

Signed and Sealed this

Twenty-first Day of November, 1995

Bruce Lehman

*Attest:*

BRUCE LEHMAN

*Attesting Officer*

*Commissioner of Patents and Trademarks*